US010215457B2

(12) United States Patent
Hoffmann et al.

(10) Patent No.: US 10,215,457 B2
(45) Date of Patent: Feb. 26, 2019

(54) HEAT EXCHANGER FOR COOLING A HEATING TUBE AND METHOD THEREOF

(75) Inventors: Gerd Hoffmann, Bruchköbel (DE); Peter Skuk, Nidderau (DE)

(73) Assignee: Applied Materials, Inc., Santa Clara, CA (US)

( * ) Notice: Subject to any disclaimer, the term of this patent is extended or adjusted under 35 U.S.C. 154(b) by 834 days.

(21) Appl. No.: 14/363,692

(22) PCT Filed: Dec. 9, 2011

(86) PCT No.: PCT/EP2011/072371

§ 371 (c)(1),
(2), (4) Date: Dec. 11, 2014

(87) PCT Pub. No.: WO2013/083204

PCT Pub. Date: Jun. 13, 2013

(65) Prior Publication Data

US 2015/0128641 A1 May 14, 2015

(51) Int. Cl.

| | |
|---|---|
| ***F28D 7/00*** | (2006.01) |
| ***F28F 1/00*** | (2006.01) |
| ***F25B 39/02*** | (2006.01) |
| ***F28D 21/00*** | (2006.01) |
| ***F28F 13/10*** | (2006.01) |

(52) U.S. Cl.

CPC ..... *F25B 39/02* (2013.01); *F28D 7/0008* (2013.01); *F28F 1/00* (2013.01); *F28D 2021/0028* (2013.01); *F28F 13/10* (2013.01)

(58) Field of Classification Search

CPC ..... F25B 39/02; F28D 7/0008; F28F 13/00; F28F 1/00

See application file for complete search history.

(56) References Cited

U.S. PATENT DOCUMENTS

| | | | | |
|---|---|---|---|---|
| 3,799,257 | A * | 3/1974 | De Clercq | F22B 1/063 122/510 |
| 6,247,525 | B1 | 6/2001 | Smith et al. | |
| 2004/0013800 | A1 | 1/2004 | Strauch et al. | |
| 2005/0183844 | A1 | 8/2005 | Tilton et al. | |
| 2006/0204648 | A1* | 9/2006 | Lee | C23C 14/243 427/8 |

(Continued)

FOREIGN PATENT DOCUMENTS

| | | |
|---|---|---|
| CN | 1875467 A | 12/2006 |
| CN | 1915806 A | 2/2007 |

(Continued)

OTHER PUBLICATIONS

Chinese Office Action dated Jan. 20, 2017, for Chinese Patent Application No. 201180075395.6.

(Continued)

*Primary Examiner* — Elizabeth J Martin

(74) *Attorney, Agent, or Firm* — Patterson + Sheridan, LLP

(57) ABSTRACT

A heat exchanger for cooling a heating tube is described, comprising at least two cooling pipes, wherein the at least two cooling pipes are arranged such that each of the at least two cooling pipes are configured to be in thermal contact with the heating tube; and a means for generating an aerosol being configured to provide the aerosol in the at least two cooling pipes.

16 Claims, 9 Drawing Sheets

(56) References Cited

U.S. PATENT DOCUMENTS

| | | | | |
|---|---|---|---|---|
| 2007/0137575 | A1* | 6/2007 | Ohmi | C23C 16/4411 118/723 MW |
| 2007/0163502 | A1 | 7/2007 | Nozawa et al. | |
| 2009/0320500 | A1 | 12/2009 | Kim et al. | |
| 2011/0059260 | A1* | 3/2011 | Stirniman | F16N 7/34 427/458 |

FOREIGN PATENT DOCUMENTS

| | | | |
|---|---|---|---|
| CN | 102139254 | A | 8/2011 |
| CN | 102165090 | A | 8/2011 |
| EP | 1681715 | A1 | 7/2006 |
| JP | 2008517756 | A | 5/2008 |
| KR | 20060085943 | A | 7/2006 |
| KR | 20060097087 | A | 9/2006 |
| KR | 20110127285 | A | 11/2011 |
| WO | 1998/037976 | A1 | 9/1998 |
| WO | 2008/126595 | A1 | 10/2008 |

OTHER PUBLICATIONS

International Search Report dated Nov. 7, 2012, in corresponding international application No. PCT/EP2011/072371.
EP Office Communication, Application No. 11 801 675.7, dated Feb. 26, 2018, 7 pages.
KR10-2014-7018778 Office Action dated Jan. 30, 2018, 11 pages, (original and translation).

* cited by examiner

HEAT EXCHANGER FOR COOLING A HEATING TUBE AND METHOD THEREOF

FIELD OF THE INVENTION

Embodiments of the present invention relate to a heat exchanger for cooling a heating tube, used for example as an evaporator, and a method of cooling a heating tube.

BACKGROUND OF THE INVENTION

Heating tubes are used for example in the semiconductor industry to deposit thin films. Materials are vaporized in the heating tube, and the vapor is passed through an opening before depositing on a substrate. For example, triazines such as melamine may be vaporized, and the vapor, after passing through an opening, deposited on a substrate for coating. The heating tube must occasionally be cooled down, for example to replace the coating material (e.g. melamine), because it becomes depleted after being used to coat a number of substrates. The overall rate of production can be influenced by various operation times, particularly the time required to cool down the heating tube. Thus, a problem associated with heating tubes as they are used in coating applications is the time required for cooling down, with rapid cooling times being more desirable.

Although liquid water can be used in some circumstances as a coolant of hot apparatuses, the efficacy of water due in part to its high specific heat capacity and/or heat of vaporization, there are circumstances when using liquid water to cool items causes significant problems. For example, when temperatures are greater than the boiling temperature of water, its use as a coolant in a heat exchanger may cause high pressures, due to rapid vaporization of the water. High pressures may rupture gaskets and seals, and lead to failure of the heat exchanger.

There is a strong desire for a heat exchanger, particularly for use in cooling a heating tube or evaporator, which can increase the cooling rate, thereby increasing the productivity of the heating tube.

In view of the above, it is an object of the present invention to provide a heat exchanger that overcomes at least some of the problems in the art.

SUMMARY

According to an embodiment, a heat exchanger 100 for cooling a heating tube 10 is provided, comprising: at least two cooling pipes 20, wherein the at least two cooling pipes are arranged such that each of the at least two cooling pipes 20 are configured to be in thermal contact with the heating tube 10; and a means for generating an aerosol 50 being configured to provide the aerosol in the at least two cooling pipes.

According to another embodiment, a method of cooling a heating tube of an evaporator is provided, comprising injecting an aerosol into at least two cooling pipes, the at least two cooling pipes in thermal contact with the heating tube.

BRIEF DESCRIPTION OF THE DRAWINGS

So that the manner in which the above recited features of the present invention can be understood in detail, a more particular description of the invention, briefly summarized above, may be had by reference to embodiments. The accompanying drawings relate to embodiments of the invention and are described in the following.

DETAILED DESCRIPTION OF THE INVENTION

Reference will now be made in detail to the various embodiments of the invention, one or more examples of which are illustrated in the figures. Within the following description of the drawings, the same reference numbers refer to same components. Generally, only the differences with respect to individual embodiments are described. Each example is provided by way of explanation and is not meant as a limitation. Further, features illustrated or described as part of one embodiment can be used on or in conjunction with other embodiments to yield yet a further embodiment. It is intended that the description includes such modifications and variations.

Herein, aerosol is intended to mean a gaseous suspension of small liquid droplets, especially water droplets or droplets comprising water. Herein, capillary is intended to mean a tube or pipe, optionally round, with an inner cross-sectional area from about 0.5 $mm^2$ to about 7 $mm^2$, or about 3 $mm^2$; or alternatively or additionally a tube or pipe, optionally round, having an inner width or inner diameter from about 0.5 mm to about 3 mm, of or about 2 mm.

Herein, heat capacity may mean volumetric heat capacity or molar heat capacity or the like; thus heat capacity can be an extensive property as is it usually defined, or may be an intensive property (e.g. the heat capacity at standard conditions of water is generally higher than the heat capacity of nitrogen).

Figure 1:
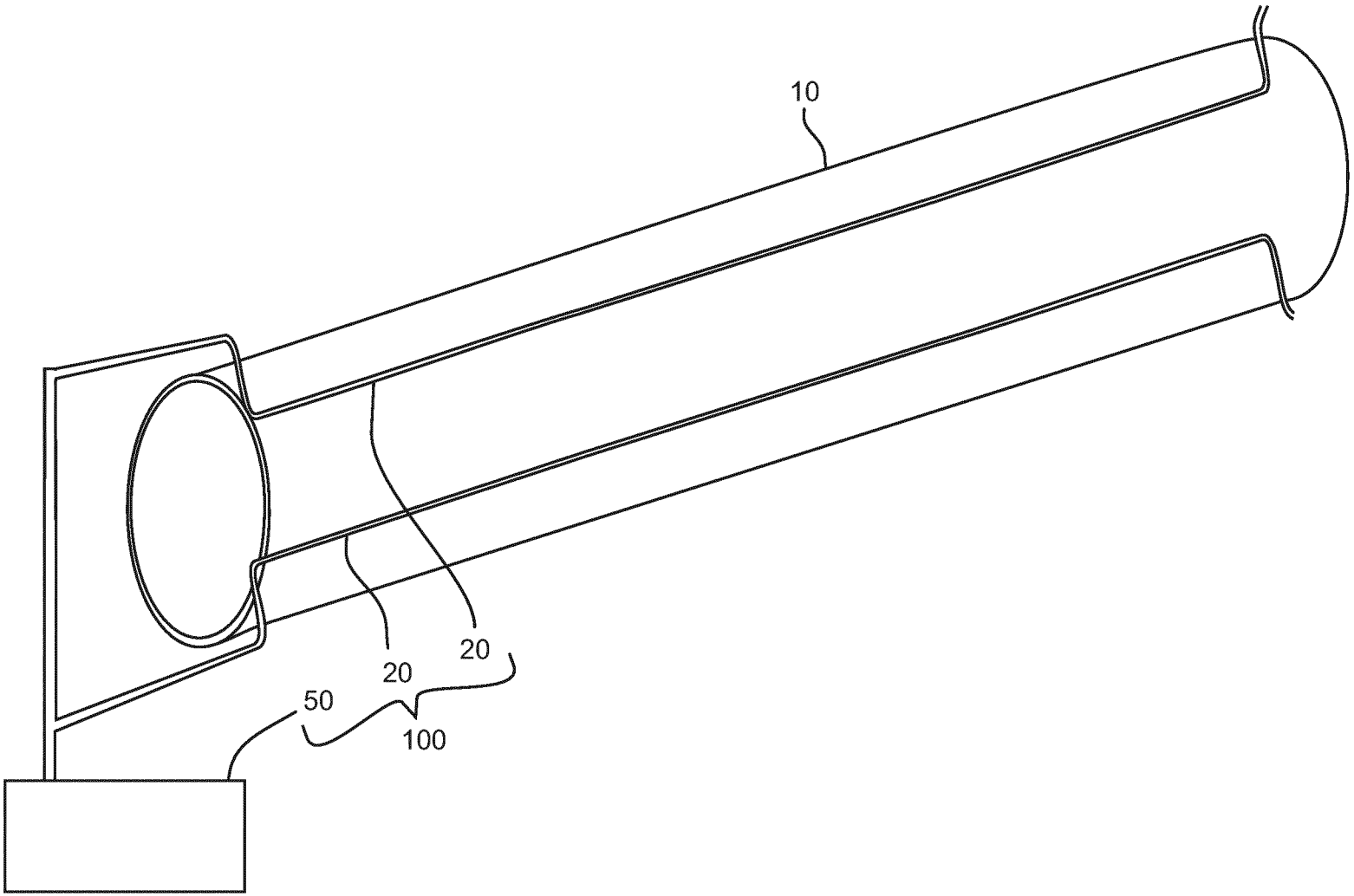
FIG. 1 shows a heat exchanger configured to be in thermal contact with a heating tube, according to embodiments described herein.
Figure 2:
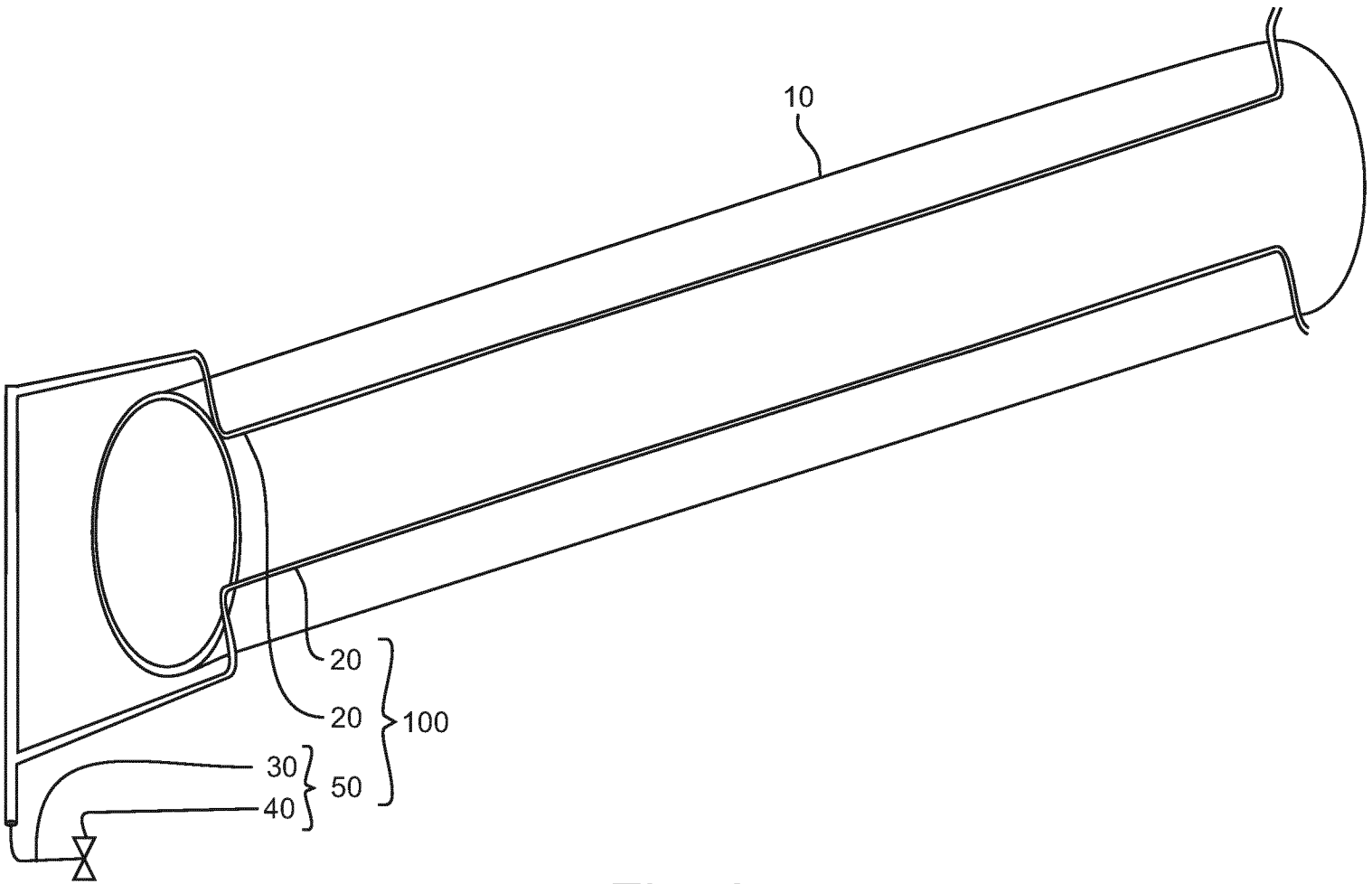
FIG. 2 shows a heat exchanger configured to be in thermal contact with a heating tube, according to embodiments described herein.

FIG. 1 shows is a heat exchanger 100, comprising two cooling pipes 20 and a means for generating an aerosol 50, according to embodiments described herein. More than two cooling pipes are also contemplated, the cooling pipes being configured to be in thermal contact with a heating tube 10, which may be an evaporator or evaporative coater optionally placed within a vacuum chamber. When an aerosol is flowed through the cooling pipes, the heating tube is cooled more quickly than the case of cooling with a nitrogen gas (without the aerosol).

For example, cooling experiments were done on a hot heating tube at an initial temperature of 350° C. using either nitrogen at atmospheric pressure or an aerosol flow, each heat exchange medium (the nitrogen or aerosol) at an initial temperature near room temperature, before thermal contact with the heating tube. With atmospheric pressure nitrogen, a temperature drop from 350° C. to 200° C. took approximately half an hour, whereas the aerosol took 7 minutes. Other comparisons of cooling rates (of different initial and final temperatures, e.g. cooling from 350° C. to 100° C.) can give even more time savings, for example a 15 minute cooling process using aerosol may compare to an hour long process using a different heat exchange medium. The use of an aerosol heat exchange medium provides a desirably fast cooling rate, and can enable greater productivity of an evaporator, for example.

The heating tube and/or evaporator described herein may be placed in vacuum systems, with heat exchanger configured for cooling the heating tube and/or evaporator. Often, vacuum operation precludes the use of liquid water based heat exchangers which are most often used at atmospheric pressure. Embodiments of heat exchangers herein enable the rapid cooling of high temperature and/or low pressure apparatuses such as heating tubes and/or evaporators.

In an embodiment, the heating tube is part of an evaporator which may be used for coating an organic material such as a triazine, such as melamine. Typically the evaporator is heated by electric heating coils raised to about 350° C. to 400° C., and the organic material, located inside the evaporator and heating tube is vaporized, either through evaporation or sublimation (for melamine, sublimation) at from 300° C. to 400° C. The organic vapor typically passes through an opening such as a slit and is deposited as a layer on a substrate. After coating the substrate, the heating is turned off and the cooling process begins. Cooling in many situations must be done in vacuum or without exposure to air at least partly because of the reactivity of the hot coating material. For example, many triazines, an example of which is melamine, may decompose upon exposure to the atmosphere when the temperature exceeds approximately 200° C. Thus, the heating tube is cooled down from the coating temperature of 200° C. or higher, which may be 300° C. and higher, or from 350° C. to 400° C.

In an embodiment, the liquid droplets of the aerosol are an aqueous solution, for example water mixed with a boiling point elevator such as propylene glycol or ethylene glycol. By using boiling point elevators, the specific heat capacity of the aerosol may be adjusted, e.g. lowered; and the boiling temperature of the liquid droplets may be adjusted, e.g. highered. The rate of cooling the heating tube, and alternatively or additionally the heat exchanger performance characteristics (e.g. the heat transfer coefficient and heat transfer rate), may therefore be adjusted based on at least adjusting the composition of the aerosol and/or for example the flow rate. The droplets of the aerosol may be comprised of materials other than water, although water is preferred due to at least one of: its specific heat, heat of vaporization, lack of flammability, and low cost.

The use of aerosol, especially an aerosol comprising water droplets has an advantage that high pressures are avoided, yet the high heat capacity and heat of vaporization of aerosolized water droplets are exploited to efficiently remove heat from (i.e. to cool) the heating tube.

In an embodiment, the heating tube is cooled down using the aerosol until the cooling process is terminated or a safe temperature is reached for opening the evaporator. In yet another embodiment, the heating tube is cooled down using the aerosol until it is at a safe temperature, e.g. near 100° C., for using a liquid water based heat exchanger, the liquid water based heat exchanger also being in contact with the heating tube, and optionally sharing some components such as the cooling pipes in thermal contact with the heating tube; optionally the heat exchanger using the aerosol may share no components with a liquid water based heat exchanger that is also in thermal contact with the heating tube.

For example, by using an aerosol heat exchange medium, the time of cooling a heating tube is reduced to less than 15 minutes in comparison to approximately 60 minutes for a non-aerosol heat exchange medium. For example, by using an aerosol in the heat exchanger, the total process time may be reduced by 25% from 180 minutes to 135 minutes, having a desirable impact on the productivity and overall costs of the evaporation process which may involve multiple cycles of heating the evaporator, coating substrates, cooling the evaporator, and replenishing the coating material.

According to some embodiments which can be combined with other embodiments described herein, the cooling pipes may have an inner diameter from 6 to 10 mm, preferably 8 mm. More than two cooling pipes, configured for being in thermal contact with the heating tube, are contemplated, for example from 2 to 64, preferably 18 to 24. Each cooling pipe may extend along approximately the entire length of the heating tube, or may extend only part of the length of the heating tube, for example about a half, third, fourth, or fifth of the length of the heating tube. Alternatively or additionally, at least one or all of the cooling pipes may extend around the axis of the heating tube.

In an embodiment, the length of the cooling pipes is approximately the minimum length at which the aerosol droplets are evaporated, for example from 20 to 80 cm, or from 20 to 60 cm, or approximately 40 cm (e.g. from 35 to 45 cm).

In an embodiment, the length of the cooling pipes is approximately the length at which the aerosol droplets are evaporated. For example, with the heating tube at for example its initial temperature at the beginning of the cool-down process, for example from about 350° C. to about 400° C.; the length of the cooling pipes can be from 30 to 45 cm, or from 35 to 40 cm, or about 37 cm or about 40 cm. In an embodiment, copper cooling pipes are used, although other materials are contemplated such as metals, e.g. aluminum, alloys of copper, steel, and stainless. Materials with high thermal conductivity, such as copper, are preferred.

In an embodiment, the means for generating an aerosol comprises a capillary and a valve, preferably a pulsed valve. In an embodiment, the means for generating an aerosol comprises a vibrating element for example a piezoelectric element vibrating at ultrasonic frequencies or a vibrating membrane, plate, or mesh. For example, a means for generating an aerosol, in other words an aerosol generator, may include a perforated vibrating plate, configured such that droplets are produced at the perforations and carried in stream of gas.

In an embodiment, the means for generating an aerosol 50 comprises a valve 40, particularly a pulsed valve, and at least one or two capillaries 30.

Figure 3:
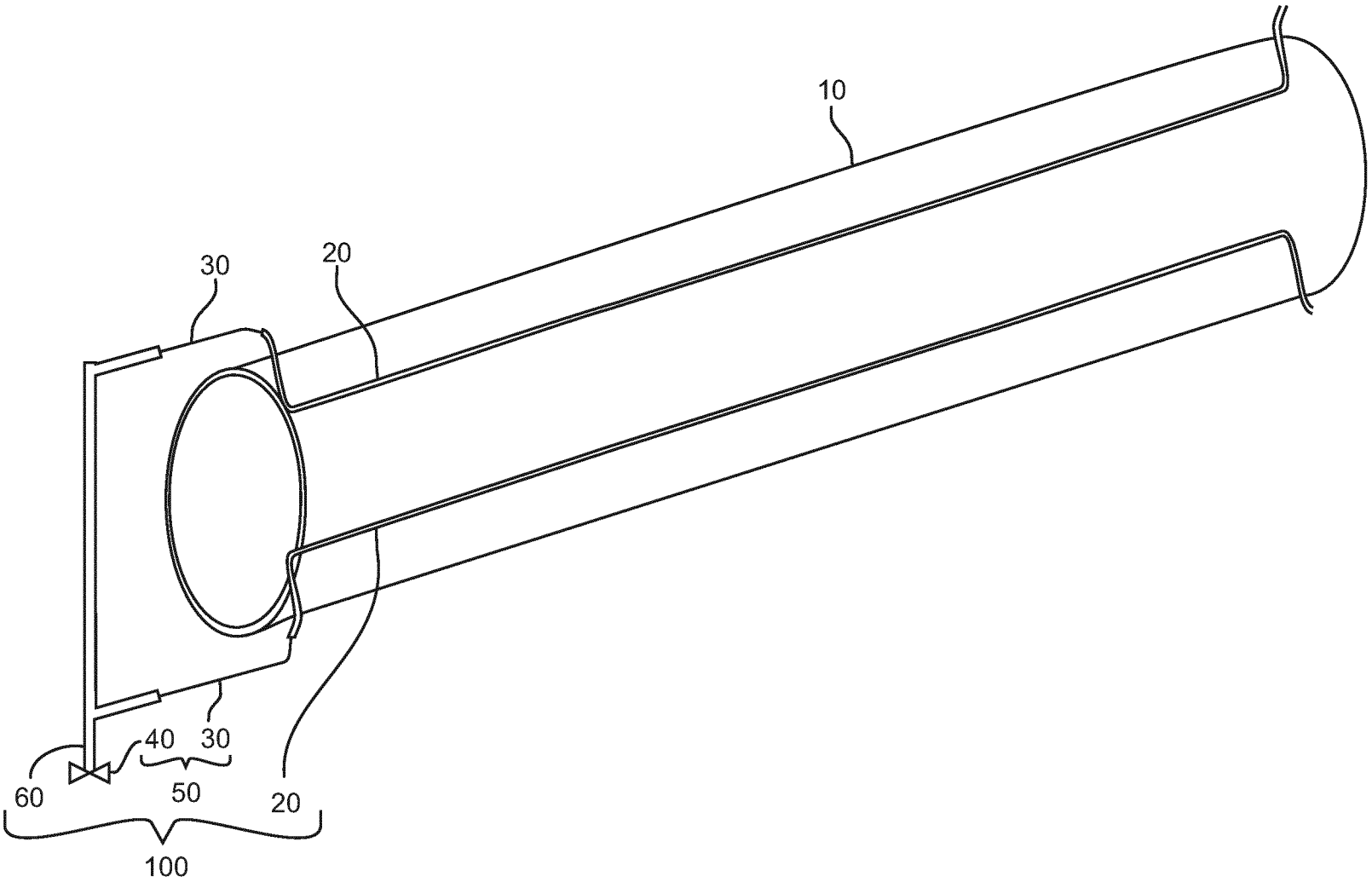
FIG. 3 shows a heat exchanger configured to be in thermal contact with a heating tube, according to embodiments described herein.

FIG. 3 shows a heat exchanger 100, comprising a means for generating an aerosol comprising capillaries 30 and a valve 40, with the capillaries 30 connected to cooling pipes 20, according to an embodiment. The cooling pipes are configured to be in thermal contact with a heating tube 10, and the valve 40 is for example a pulsed valve. In the embodiment illustrated by FIG. 3, one valve 40 can be used for more than one capillary and cooling pipe, for example one valve 40 for two capillaries 30 and two cooling pipes 20.

In an embodiment, a conduit 60 connects the valve 40 to the capillaries 30, which are further connected to the inlets of the cooling pipes 20. Having a second valve connected to, for example, two more capillaries and cooling pipes is also contemplated; in other words each valve may be connected to more than one capillary and cooling pipe. FIG. 3 depicts an embodiment in which the capillaries 30 are located on the inlet side of the cooling pipes 20.

Figure 4:
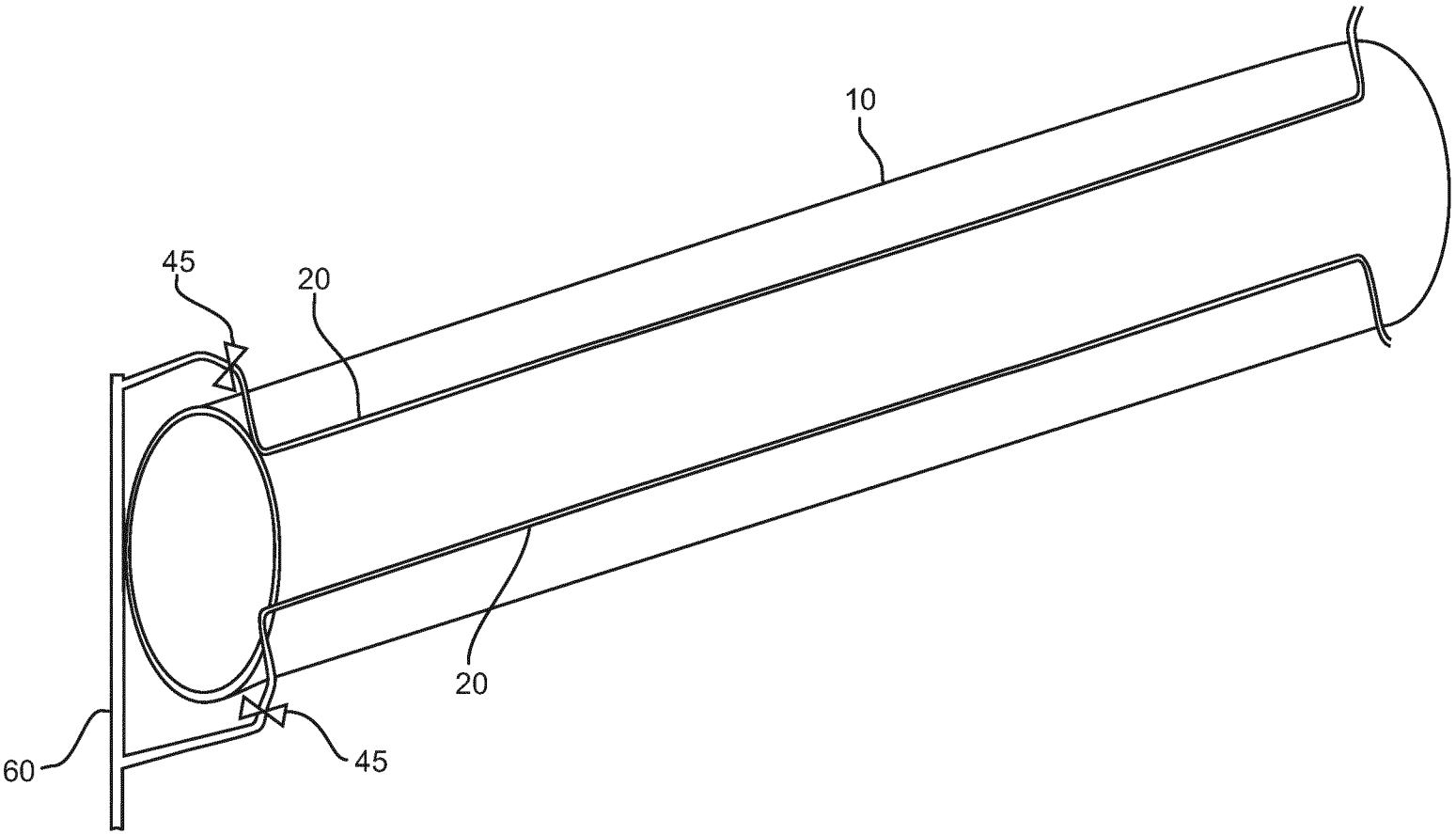
FIG. 4 shows a heat exchanger configured to be in thermal contact with a heating tube, according to embodiments described herein.

FIG. 4 shows a heat exchanger according to an embodiment, comprising cooling pipes 20 which are configured to be in thermal contact with the heating tube 10, and valves 45 on the inlet side of the cooling pipes, with a conduit 60 leading to the valves, which may be aerosol generating valves 45. According to an embodiment, the valves or aerosol generating valves are from 1 to 10 cm from the inlet to the cooling pipes, or are adjacent to the inlets of the cooling tubes 20. The means for generating an aerosol comprise the valves 45 and optionally capillaries disposed between the valves and the cooling pipes 20. An advantage of having aerosol generating valves near the inlets of the cooling pipes is that it reduces adsorption, condensation, and/or agglomeration of the aerosol droplets on walls of a conduit or other means for carrying or transporting the aerosol to the cooling pipes.

Figure 5:
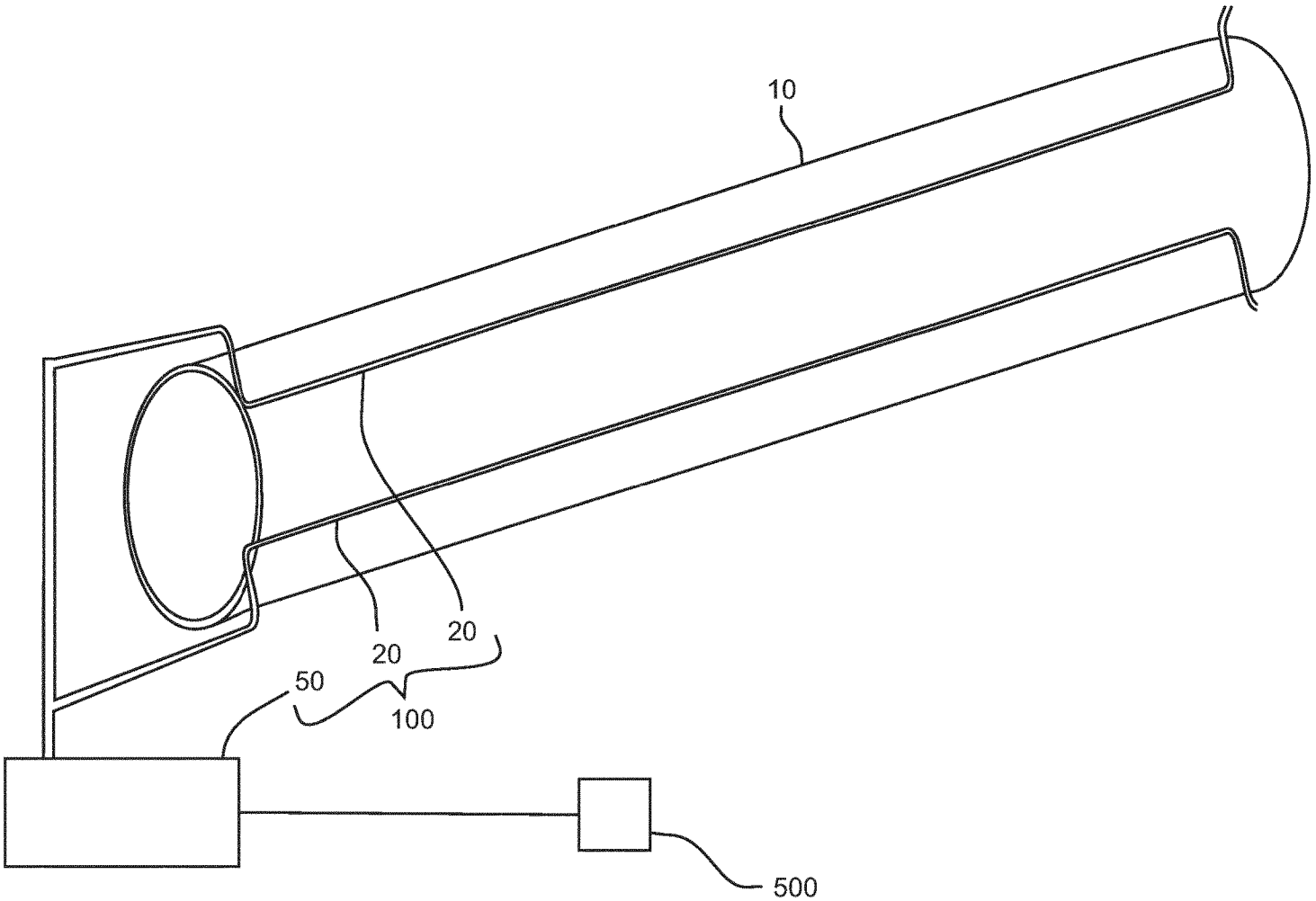
FIG. 5 shows a heat exchanger configured to be in thermal contact with a heating tube, according to embodiments described herein.
Figure 6:
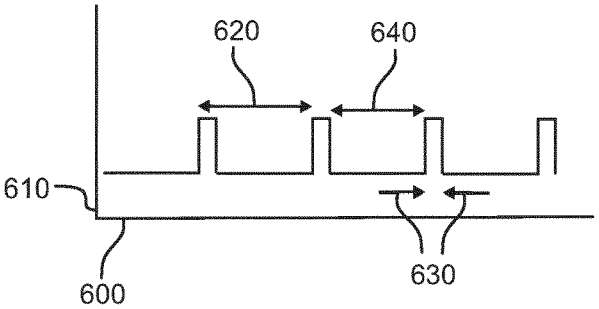
FIG. 6 shows a pulse signal to a device of generating an aerosol, according to embodiments described herein.

FIG. 5 shows a heat exchanger 100 with a controller 500, according to an embodiment. The controller is in communication with the means for generating an aerosol 50, and may comprise a processor and a memory. The controller is configured to adjust at least one of: a pulse period 620, a pulse duration 630, and a pulse delay 640; the pulse parameters are shown in FIG. 6, which shows, according to an embodiment, a time axis 600 and an amplitude axis 610, a pulse period 620, a pulse duration 630, and a pulse delay 640. For example, the controller can increase the density of the aerosol by decreasing the pulse period 620, or in other words increasing the pulse frequency. In an embodiment, the pulse parameters (pulse period, duration, and delay) are on the order of milliseconds; e.g. each pulse parameter is from about 1 ms to about 1000 ms, or from about 1 ms to about 100 ms. In another example, the pulse period is 2 ms, the pulse duration is 1 ms, and the pulse delay is 1 ms. The pulse parameters impact the cooling rate by adjusting, for example, the density of aerosol, which impacts the heat capacity of the aerosol. In an embodiment, a user can adjust the pulse parameters, and in another embodiment, the pulse parameters are selected by a computer program which is read from a computer readable medium. Alternatively or additionally, the controller may be interfaced through hardware or software with other components of the heat exchanger, heating tube, and/or evaporative coater. The controller, by adjusting the pulse parameters, may adjust the cooling rate, at least as a result of adjusting the density of the aerosol. In an embodiment, the flow rate of the heat exchange medium (comprising the aerosol) through the cooling pipes or heat exchanger may alternatively or additionally adjusted by the controller or by a second controller.

In an embodiment, when the temperature of the cooling pipe and/or heating tube reaches below 100° C., the valve(s), especially the pulsed valve(s), may be kept open so that pulsing possibly ceases and liquid water may run through the cooling pipe(s).

Figure 7:
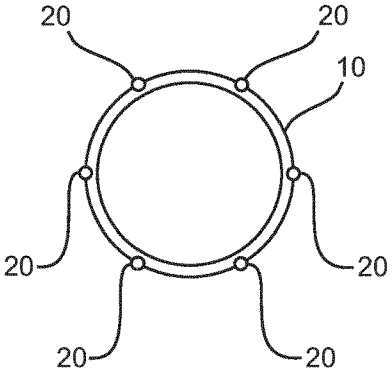
FIG. 7 shows a cross section of cooling pipes configured to be in thermal contact with a heating tube, according to embodiments described herein.

FIG. 7 shows a cross-section of the cooling pipes 20 configured to be in thermal contact with the heating tube 10, according to an embodiment. FIG. 7 shows six cooling pipes 20 in the cross-section, although other numbers are contemplated, such as from 2 to 64, preferably 18 to 24. The cooling pipes, in an embodiment, may lie parallel to the axis (i.e. the axis of symmetry, or axis of greatest symmetry, or long axis) of the heating tube, as is consistent with the cross-section shown in FIG. 7.

In an embodiment, cooling pipes 20 are arranged parallel to the axis of the heating tube 10, the cooling pipes spaced apart by 360/s degrees, where s=the number of cooling pipes; s can be from 3 to 30.

Figure 8:
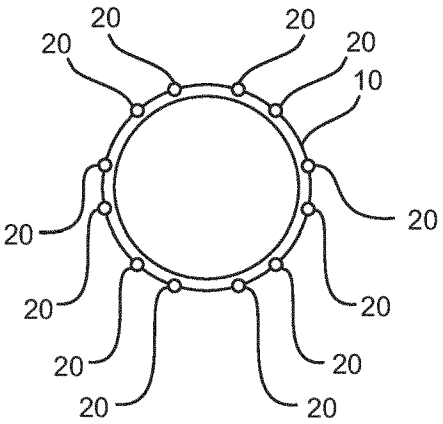
FIG. 8 shows a cross section of cooling pipes configured to be in thermal contact with a heating tube, according to embodiments described herein.

FIG. 8 shows a cross section of twelve cooling pipes 20, according to an embodiment. In an embodiment, pairs of cooling pipes are spaced apart by 360/t degrees; where t is the number of pairs of cooling pipes, for example with t=from 2, 3, 4, 5, 6, . . . 16, to 32 (FIG. 8 shows the case of t=6). For example, for the embodiment shown in FIG. 3, in which one valve is connected to two capillaries which lead to two cooling tubes, the capillaries and the cooling pipes can be grouped in pairs.

Figure 9:
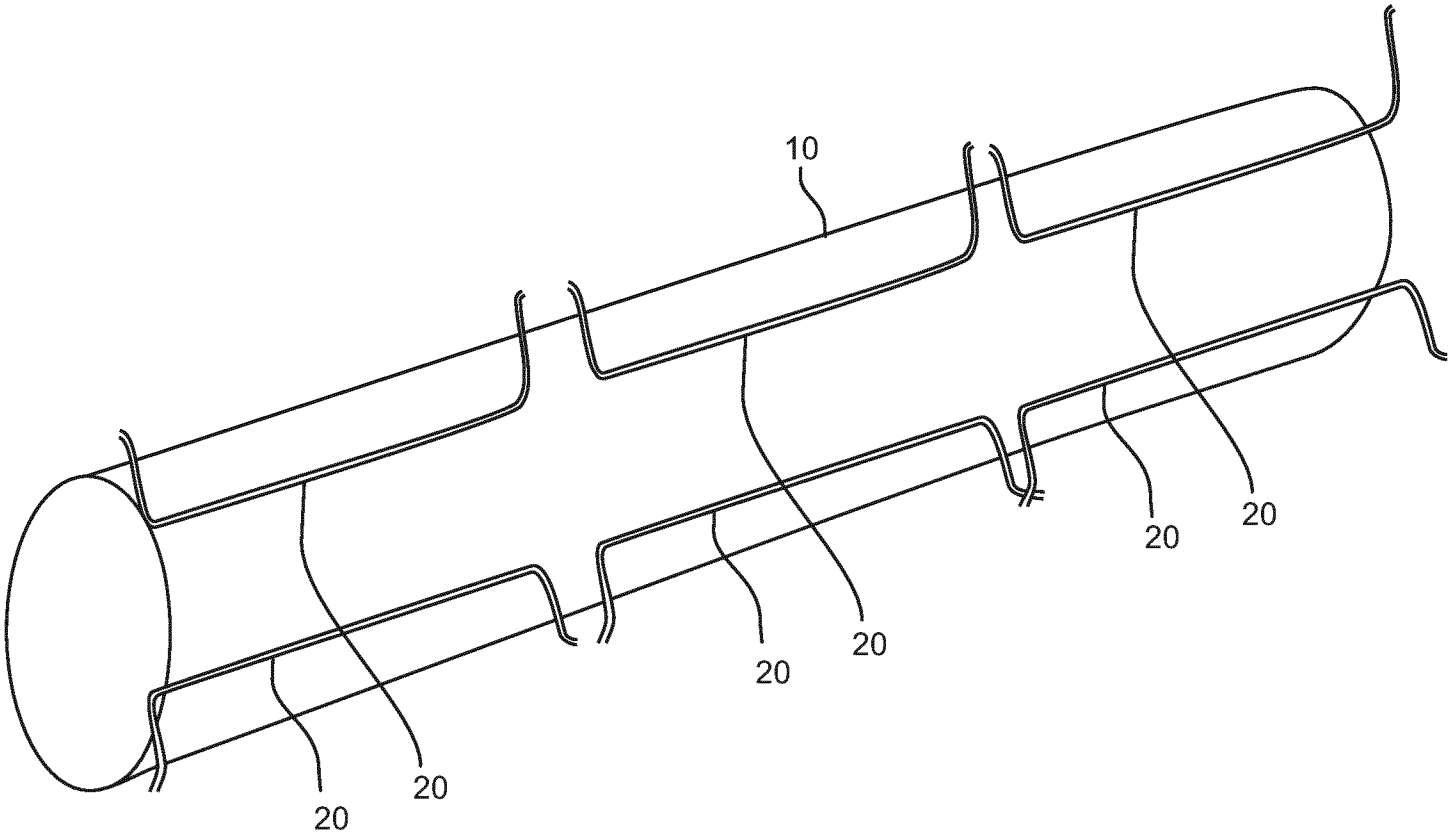
FIG. 9 shows cooling pipes of a heat exchanger configured to be in thermal contact with a heating tube, according to embodiments described herein.

FIG. 9 shows the cooling pipes 20 configured to be in thermal contact with the heating tube 10, according to an embodiment in which each cooling pipe extends a fraction of the length of the heating tube, e.g. ½, ⅓ (as shown), ¼, ⅕, etc. In an embodiment, each fraction of the length of the heating tube comprises a plurality of cooling pipes. Thus, it is contemplated that the heating tube 10 can be divided into M sections, each section comprising N cooling pipes 20 (e.g. M=3 and N=2 as shown in FIG. 9), for a total of M×N cooling pipes. For example: M can be from 1 to 6; and N can be from 2 to 16.

Figure 10:
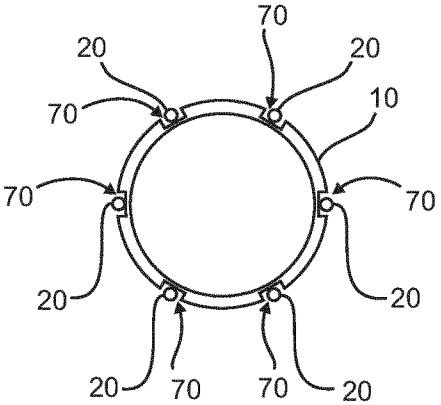
FIG. 10 shows a cross section of cooling pipes configured to be in thermal contact with a heating tube, the heating tube having grooves, according to embodiments described herein.

FIG. 10 shows a cross section of cooling pipes 20 in thermal contact with a heating tube 10, with the cooling pipes 20 disposed in grooves 70 on the heating pipe 10, according to an embodiment. An advantage of the grooves is that they may allow for greater thermal contact of the cooling pipes 20 with the heating tube 10. In an embodiment, the cooling pipes are press-fit into the grooves, such as to provide greater thermal contact between the cooling pipes 20 and the heating tube 10. The cooling pipes may alternatively or additionally be held in place by at least one fastener (not shown).

Figure 11:
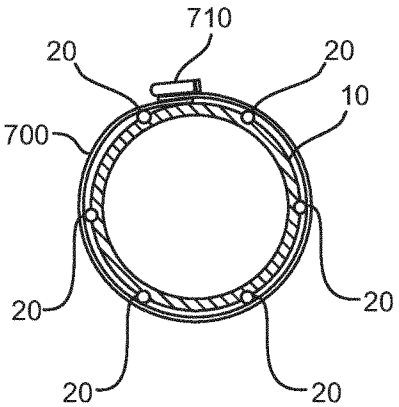
FIG. 11 shows a cross section of cooling pipes configured to be in thermal contact with a heating tube, and an outer strap, according to embodiments described herein.

FIG. 11 shows a cross section of cooling pipes 20 in thermal contact with a heating tube 10, with the cooling pipes 20 fastened to the heating tube by a fastener 700 which optionally includes a tightener 710. The fastener may be a spring clip, hose clamp, or the like. Alternatively or additionally, the cooling pipes 20 may be welded to the heating tube. An advantage of the fastener is that it leads to more robust thermal contact between the cooling pipes and the heating tube. Moreover the fastener may enable robust thermal contact after many cycles of heating and cooling, which may otherwise tend to result in some withdrawal of the cooling pipe from the heating pipe (and reducing thermal contact) due to cycles of expansion and contraction associated with heating and cooling. The use of a plurality of fasteners is contemplated, for example with 2, 3, 4 or even more fasteners in contact with each cooling pipe. For example, fasteners are placed approximately at every 5-10 cm (or even higher such as 15, 20, 25, 50 cm or values between) along the length of each cooling pipe.

Figure 12:
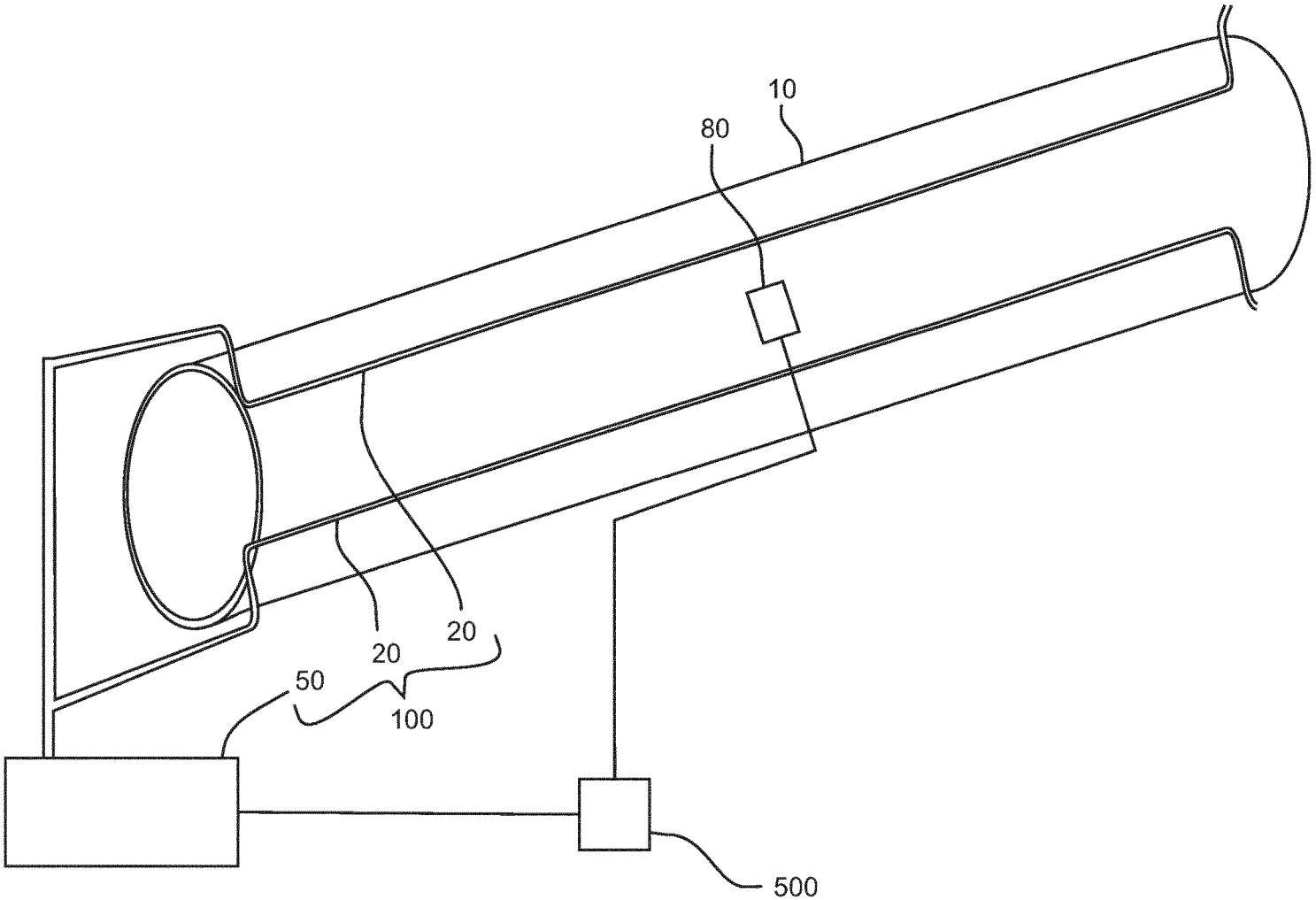
FIG. 12 shows a temperature sensor for measuring the temperature of the heating tube, communicatively coupled to a controller, according to embodiments described herein.

FIG. 12 shows a heat exchanger 100 with cooling pipes 20 configured to be in thermal contact with a heating tube 10, and a controller 500 in communication with the means for generating an aerosol and also optionally in communication with a temperature sensor 80, according to an embodiment. In an embodiment, the temperature sensor 80 indicates to a user and/or to the controller 500 the temperature of the heating tube 10. Thus, the cooling process may be terminated when a desired temperature of the heating tube 10 is reached. A desired temperature is for example: the boiling temperature of the heat exchange medium, the boiling temperature of the liquid droplets of the heat exchange medium, and approximately 100° C. in the case of a water aerosol. Alternatively or additionally, at a desired temperature, e.g. 100° C., the cooling with the aerosol based heat exchanger may be augmented or replaced by cooling with a liquid water based heat exchanger.

Several possible advantages of the temperature sensor 80 are that: it may allow the user to be informed of the temperature of the heating tube 10; it may indicate when it is safe to terminate cooling; it may indicate when it is safe to augment or replace the aerosol based cooling with another type cooling such as liquid water based cooling; and/or it may indicate to the controller data that is used to adjust the pulse parameters, which may adjust the cooling rate.

In an embodiment, one or more temperature sensors can be in thermal contact with the cooling pipes; alternatively or additionally, one or more temperature sensors can be in thermal contact with the heating tube. In an embodiment, when the temperature of the cooling pipe reaches below 100° C., the valve(s), such as the pulsed valve(s), may be opened permanently, allowing more water to go through the cooling pipe(s) than in pulsed operation, for example so that liquid water runs through the cooling pipe(s) when the temperature of the cooling pipe(s) and/or heating tube is below 100° C.

Figure 13:
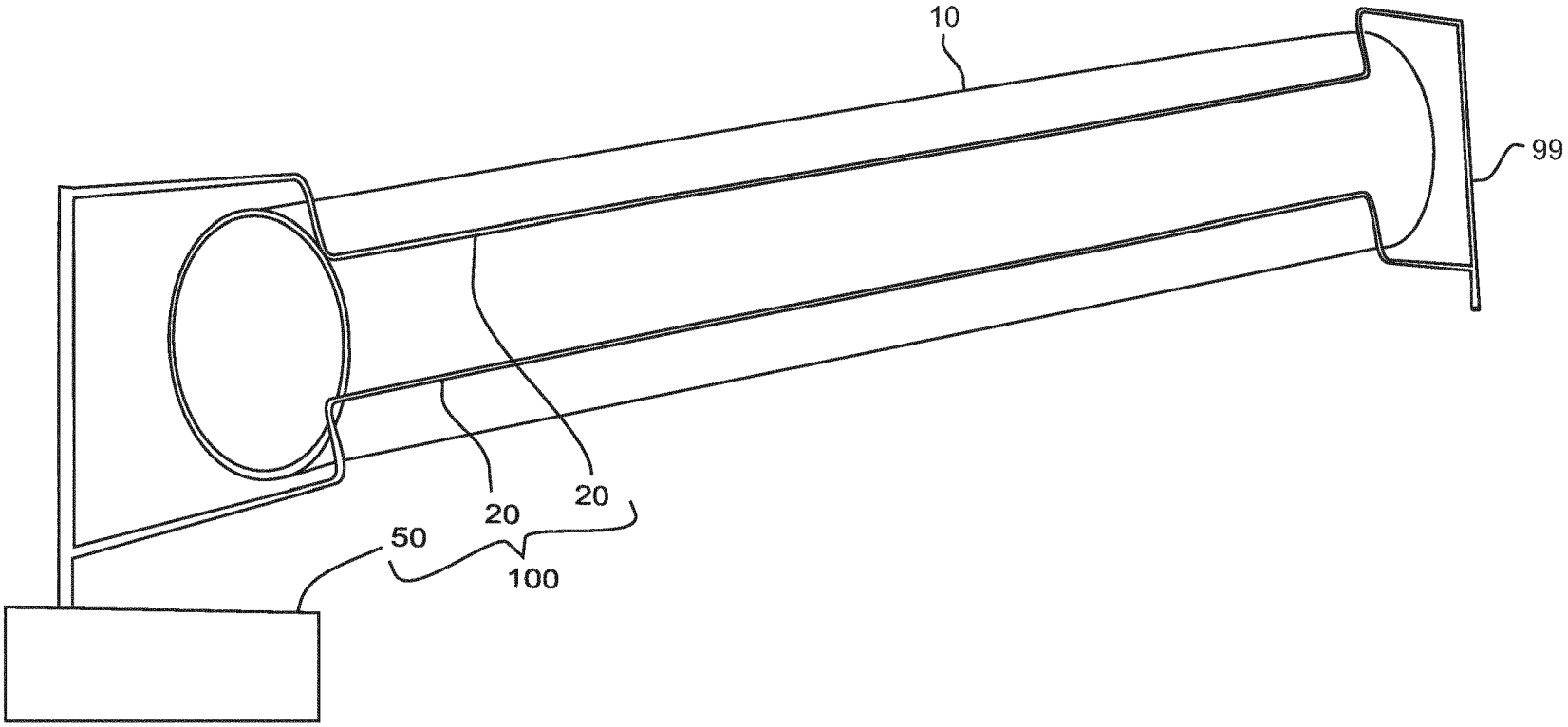
FIG. 13 shows a heat exchanger with an exhaust assembly, according to embodiments described herein.

FIG. 13 shows a heat exchanger 100 with cooling pipes 20 configured to be in thermal contact with a heating tube 10, and an exhaust port 99 connected to the cooling pipes 20, according to an embodiment. The exhaust port allows the collection of exhaust from the cooling pipes 20.

Figure 14:
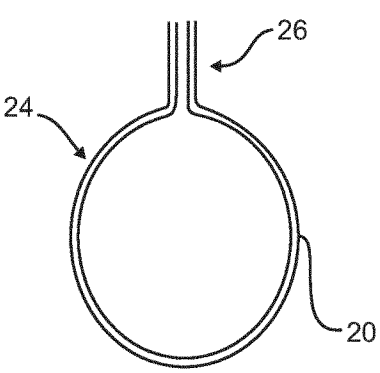
FIG. 14 shows a cooling pipe, according to embodiments described herein.

FIG. 14 shows a cooling pipe 20 comprising a loop portion 24 and a neck portion 26, according to an embodiment, which may be disposed around the heating tube 10 radially rather than parallel to the heating tube as for example the cooling pipes 20 in the embodiment of FIG. 1. The cooling pipe 20, according to the embodiment of FIG. 14, is configured to be in thermal contact with the heating tube, i.e. with the loop portion 24 in thermal contact with the heating tube, and with the neck portion 26 leading away from the heating tube. The neck portion 26 has two ends, an inlet for receiving the aerosol and an exhaust, e.g. leading to an exhaust manifold, on the other side. A heat exchanger using a cooling pipe embodiment such as that shown in FIG. 14 may also comprise a neck clamp for clamping the two ends of the neck portion 26 together which may aid in making thermal contact between the loop portion 24 and the heating tube. The neck clamp may be flexible to accommodate expansion and contraction of the cooling pipe during cycles of heating and cooling. When, optionally, cooling pipes as depicted in FIG. 14 are combined with a heating tube with grooves 70, the grooves are disposed around the heating tube (i.e. radially) to accommodate the cooling pipes 20.

While the foregoing is directed to embodiments of the invention, other and further embodiments of the invention may be devised without departing from the basic scope thereof, and the scope thereof is determined by the claims that follow.

The invention claimed is:

1. A method of cooling a heating tube of an evaporator, comprising:

heating the evaporator and vaporizing material located inside the heating tube;

coating a substrate with the vaporized material; and after coating the substrate, turning off the heating and cooling down the heating tube by an injection of an aerosol into at least two cooling pipes, the at least two cooling pipes in thermal contact with the heating tube.

2. The method of cooling a heating tube of an evaporator of claim 1, wherein an initial temperature of the heating tube is 200° C. or higher.

3. The method of cooling a heating tube of an evaporator of claim 2, wherein the injection of the aerosol is a pulsed injection, and wherein at least one pulse parameter is at least one of a pulse period, a pulse duration, and a pulse delay.

4. The method of cooling a heating tube of an evaporator of claim 3, wherein the pulse duration is from 1millisecond to 10 milliseconds.

5. The method of cooling a heating tube of an evaporator of claim 3, wherein the at least one pulse parameter is variable.

6. The method of cooling a heating tube of an evaporator of claim 1, wherein the at least two cooling pipes contains up to 64 cooling pipes.

7. The method of cooling a heating tube of an evaporator of claim 1, wherein the cooling pipe inner diameter is from 12 $mm^2$ to 200 $mm^2$.

8. The method of cooling a heating tube of an evaporator of claim 1, wherein the length of each portion of the cooling pipe in contact with the heating tube is from 20 cm to 100 cm.

9. A method of cooling a heating tube of an evaporator, comprising:

heating the evaporator and vaporizing material located inside the heating tube;

coating a substrate with the vaporized material; and after coating the substrate, turning off the heating and cooling down the heating tube by an injection of an aerosol into at least one cooling pipe, the at least one cooling pipe in thermal contact with the heating tube.

10. The method of cooling a heating tube of an evaporator of claim 9, wherein the at least one cooling pipe comprises at least two cooling pipes in thermal contact with the heating tube.

11. The method of cooling a heating tube of an evaporator of claim 9, wherein the at least one cooling pipe contains from 2 to 64 cooling pipes.

12. The method of cooling a heating tube of an evaporator of claim 9, wherein the cooling pipe inner diameter is from 12 $mm^2$ to 200 $mm^2$.

13. The method of cooling a heating tube of an evaporator of claim 9, wherein the length of each portion of the cooling pipe in contact with the heating tube is from 20 cm to 100 cm.

14. The method of cooling a heating tube of an evaporator of claim 9, wherein an initial temperature of the heating tube is 200° C. or higher.

15. The method of cooling a heating tube of an evaporator of claim 14, wherein the injection of the aerosol is a pulsed injection, and wherein at least one pulse parameter is at least one of a pulse period, a pulse duration, and a pulse delay.

16. The method of cooling a heating tube of an evaporator of claim 15, wherein the pulse duration is from 1 millisecond to 10 milliseconds.

* * * * *